US005749742A

United States Patent [19]

Bertuzzi, Jr. et al.

[11] Patent Number: 5,749,742

[45] Date of Patent: May 12, 1998

[54] MAXIMUM RETENTION SERVICEABLE HIGH VOLTAGE SPARK PLUG ADAPTER

[75] Inventors: Dale Charles Bertuzzi, Jr.; Michael James Bezusko, both of Warren; David Allen Nuss, Cortland, all of Ohio

[73] Assignee: General Motors Corporation, Detroit, Mich.

[21] Appl. No.: 730,026

[22] Filed: Oct. 15, 1996

[51] Int. Cl.[6] ..... H01R 13/44

[52] U.S. Cl. ..... 439/125; 439/346; 439/348

[58] Field of Search ..... 439/125–128, 439/346, 348

[56] References Cited

FOREIGN PATENT DOCUMENTS 1064881 5/1954 France ..... 439/348

843859 8/1960 United Kingdom ..... 439/348

*Primary Examiner*—Gary F. Paumen

*Attorney, Agent, or Firm*—Cary W. Brooks

[57] ABSTRACT

The maximum retention serviceable high voltage spark plug adapter according to the present invention provides an electrical connection between a cable and a spark plug utilizing a stationary terminal crimped onto the cable by a strip and fold technique. Sliding terminals are held against the crimp terminal and a spark plug terminal post by a compression style terminal spring. This terminal spring is also the electrical connection between the two sliding terminals. The electrical connection to the spark plug terminal under all operating conditions is assured by a constant pressure of the terminal spring thus eliminating the possibility of microarcing and fretting.

13 Claims, 2 Drawing Sheets

MAXIMUM RETENTION SERVICEABLE HIGH VOLTAGE SPARK PLUG ADAPTER

TECHNICAL FIELD

This invention relates to removable spark plug adapters.

BACKGROUND OF THE INVENTION

The high voltage connection of secondary wiring of an ignition cable to a spark plug for an internal combustion engine has remained virtually unchanged for many decades. A typical connection scheme is shown in FIG. 1 for a spark plug 10 with a mated secondary wiring connection consisting of the cable 12, the secondary terminal 14, and snap ring 15 which is mechanically attached to the spark plug terminal post 17. The entire connection is typically covered by an elastomeric boot 16, which provides an environmental and electrical seal of the connection.

The primary functions of this connector assembly consists of maintaining an adequate mechanical, electrical, and dielectric connection of the secondary cable to the spark plug while allowing repetitive removals for servicing the spark plug and other engine service requirements. However, there are a number of shortcomings of the traditional connection scheme that limit the functional capability of the interface to meet its three primary functions over the expected operating life and operating conditions experienced in today's and future internal combustion engines.

With respect to mechanical considerations, the prior art secondary cable terminals have considerable variation in the force required to connect them to the spark plug, which can at times hamper connection integrity and reliability. They are also prone to deformation and damage by repeated engage and disengage cycles to the spark plugs, thereby reducing the engagement capability and potentially creating microarcing due to insufficient contact to the spark plug terminal post. This microarcing can cause wearing and premature failure of the cable conductor, and cause intermittent misfires which are detectable by current combustion monitoring controls. The secondary cable terminal removal force from the spark plug post can increase with time at engine operating temperatures and exceed the terminal to cable retention force, thereby creating a disconnect or terminal pull off during spark plug servicing.

With respect to maintaining adequate dielectric isolation of the connector assembly, the prior art has several critical shortcomings that limit both the maximum voltage capability of the connection and its durability over time. These shortcomings are degradation of the electrical seal between the boot and plug, corona initiation, and nonuniform high electric field intensity. The degradation of the prior art electrical seal between the boot and plug occurs because of two major mechanisms: loss of seal pressure due to compression set of the elastomeric material with time at operating temperatures, and tearing of the seal area of the elastomeric boot on removal due to adhesion to the plug insulator.

The prior art applications with heat shields utilize electrical grounding features which impair the mechanical reliability of the connection. Poor grounding of a metal heat shield could result in induced voltages in the heat shield resulting in arcing to ground and radio frequency interference generations.

The prior art cable termination and plug post terminals have geometries that are irregular which create high potential gradients. These high potential gradients lead to high E-field intensities, many which are located in weak dielectric areas. Further, many of these prior art devices fall short of engine manufacturer's durability expectations.

The present invention provides alternatives and advantages over the prior art.

SUMMARY OF THE INVENTION

The maximum retention serviceable high voltage spark plug adapter according to the present invention provides an electrical connection between a cable and a spark plug utilizing a stationary terminal crimped onto the cable by a strip and fold technique. Sliding terminals are held against the crimp terminal and a spark plug terminal post by a compression style terminal spring. This terminal spring is also the electrical connection between the two sliding terminals. The electrical connection to the spark plug terminal under all operating conditions is assured by a constant pressure of the terminal spring thus eliminating the possibility of microarcing and fretting.

Maximum retension is realized and maintained by a trapped ball/sliding sleeve mechanism. Ease of assembly is achieved by trapping the sliding sleeve into a retracted position with an interference fit between retaining spheres, the sliding sleeve and one of the sliding terminals. After the sliding terminal is moved from engagement with the spark plug post, full mating to the spark plug terminal is realized by the sliding sleeve moving relative to the rest of the connector body and trapping the retaining spheres between the sliding sleeve and the spark plug terminal. The maximum retention spark plug adapter according to this invention cannot be removed once assembled in this position without moving the sliding sleeve to a retracted position.

Removal of the maximum retention spark plug adapter is accomplished by moving the sliding sleeve away from the spark plug. This allows the previously trapped retaining spheres to move radially away from the terminal post and return to their retracted positions. The assembly will then slide off the spark plug with no mechanical restriction whatsoever.

These and other objects, features and advantages of the present invention will become apparent from the following brief description of the drawings, detailed description and appended claims and drawings.

DETAIL DESCRIPTION

Figure 3:
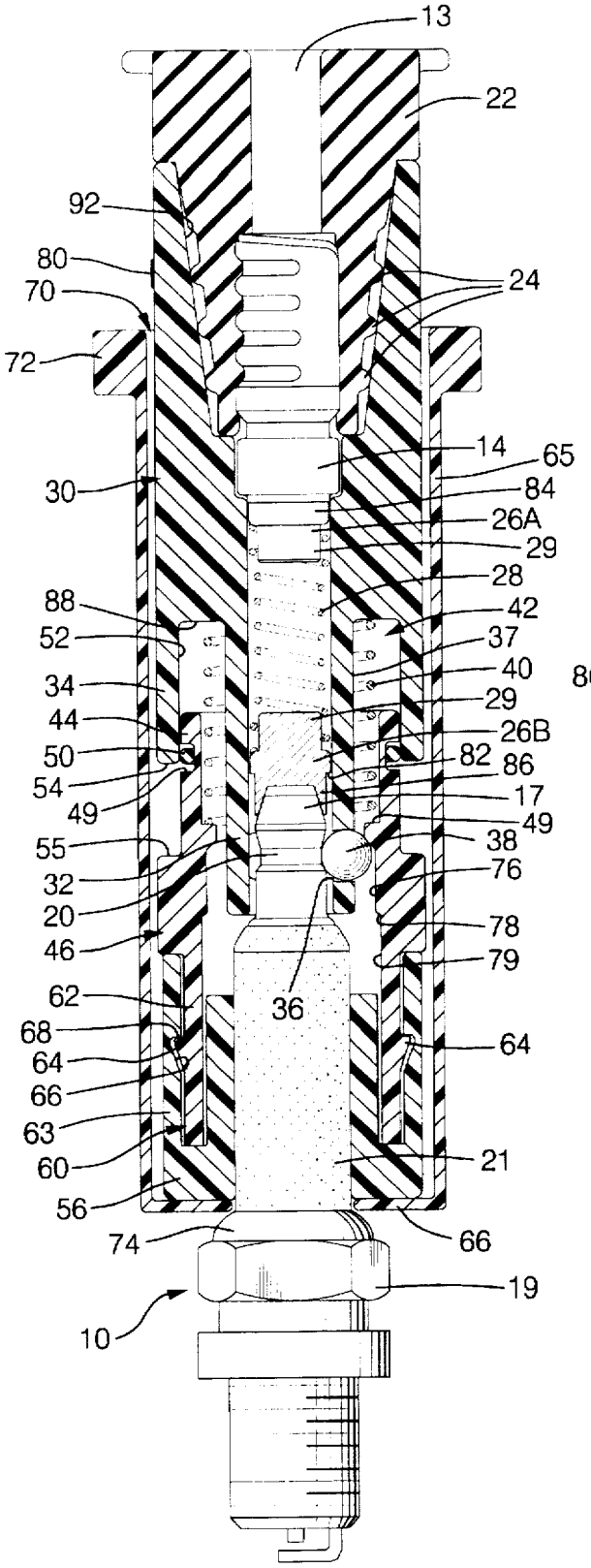
FIG. 3 is a sectional view of an adapter according to the present invention in a mated position with the spark plug.
Figure 4:
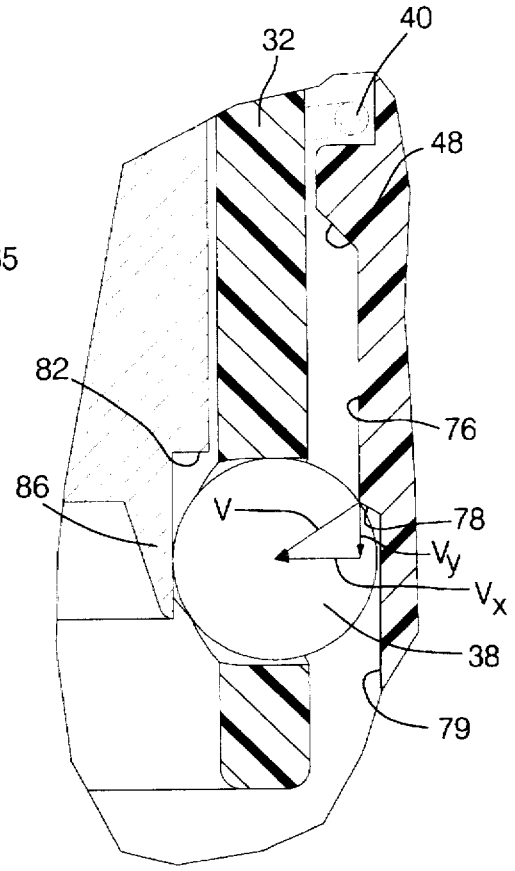
FIG. 4 is an enlargement of a portion of FIG. 2 illustrating the movement of the retaining spheres in an adapter according to the present invention.

As shown in FIG. 3, the maximum retention spark plug adapter according to the present invention is intended to be utilized with a conventional spark plug 10 including a metallic outer housing including hex nut 19, a ceramic inner sleeve 21 and an internal high voltage spark plug terminal 17 having an undercut or annular groove 20 formed near the end of the terminal. The maximum retention spark plug adapter includes a spark plug cable 13 having a terminal 14 at one end. A cable seal 22 may surround the spark plug cable and may have multiple sealing ribs 24 for engaging a tapered surface 92 of a connector body 30.

Two sliding terminals 26a, 26b are designed to make electrical contact to the terminal post 17 on the spark plug as well as electrical contact to the cable terminal 14 of the spark plug cable. The sliding terminals 26a, 26b are held against the cable terminal 14 and the spark plug post 17 respectively by a compression style terminal spring 28. The terminal spring 28 is also the electrical connection between the two sliding terminals 26a, 26b. The electrical connection to the spark plug terminal 17 under all operating conditions is assured by the constant pressure of the terminal spring eliminating the possibility of microarcing or fretting.

A tube-like connector body 30 surrounds the cable seal 22, both of the sliding terminals 26a, 26b and a portion of the terminal spring 28. The connector body 30 includes first and second spaced apart concentric tubes 32, 34 respectively. An inner tube 32 extends downwardly a distance greater than the outer tube 34. The inner tube 32 is constructed and arranged to house a sliding terminal 26b and terminal spring 28. The lower end of the inner tube has holes 36, preferably three holes, formed therein each for receiving a retaining sphere 38. A first coil spring 40 surrounds an outer surface 37 of the inner tube 32 and is housed partially in the space 42 between the inner tube 32 and the outer tube 34.

An upper leg portion 44 of a sliding retainer 46 is also received in the space 42 between the inner 32 and outer tube 34 and surrounds the first coil spring 40. The first coil spring 40 engages the upper surface of an inwardly extending rim 48 defined along the inside wall of the sliding retainer 46. An outer surface of the upper leg portion of the sliding retainer includes an annular groove 49 for receiving a portion of an O-ring 50 which is constructed and arranged to also engage the inside wall 52 of the outer tube 34. The sliding O-ring functions as a dielectric barrier and an environmental seal between the connector body 30 and the sliding retainer 46. The sliding retainer 46 also includes an outwardly extending ledge 55 constructed and arranged to selectively be engaged by a lower end 54 of the outer tube 34. The sliding retainer 46 includes a middle body portion having a smooth flat inside wall 76 terminating at a shoulder 78 (preferably sloped) at a lower end. The shoulder 78 extends to a downwardly extending leg 62 and as such defines an internal step.

A spark plug seal 56 of an elastomer or rubber type material is provided having a central bore 57 and a concentric annular recess 60. The spark plug seal 56 is constructed and arranged to receive the ceramic portion 21 of the spark plug in the central bore and to receive a downwardly extending leg 62 of the sliding retainer 46 in the concentric annular recess 60. The downwardly extending leg 62 of the sliding retainer includes an outwardly extending ledge 64. A second wall 63 of the spark plug seal defining the annular recess includes a notch 66 and a shoulder 68 for engaging the outwardly extending ledge 64 of the downwardly extending leg.

An optional removable cylinder 65 may be provided. The removable cylinder 65 includes a tube shaped body and a cap 66 at one end having a small opening formed therein coinciding with the central bore 57 of the seal and for receiving and accommodating the spark plug. The removable cylinder 65 has a larger hole 70 at the other end for accommodating and receiving the maximum retention spark plug adapter described above. The cap 66 acts as a stop for the spark plug seal 56 and other components of the maximum retention spark plug adapter. The removable cylinder may include an outwardly extending flange 72 which provides a convenient gripping point for removing the maximum retention spark plug adapter. Electrical grounding of the removable cylinder 65 is accomplished by the spring loaded contact between the cap 66 and the spark plug shell 74 by the retainer coil spring 40 surrounding the inner tube 32 or sleeve of the connector body. The cap 66 provides a uniform distribution force applied to the spark plug seal to facilitate removal without damage to the spark plug seal.

Figure 1:
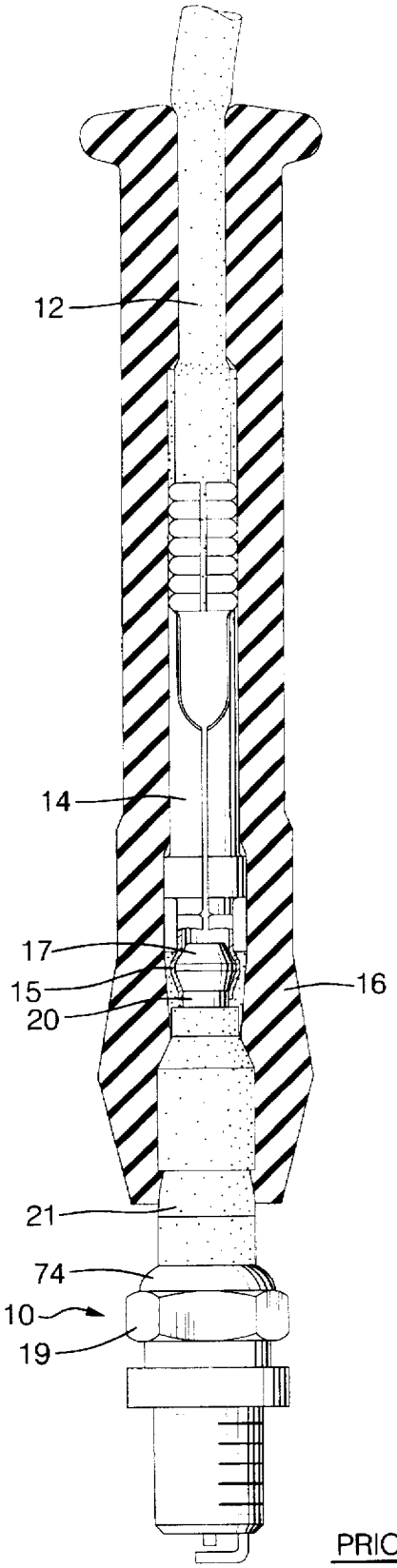
PRIOR ART FIG. 1
FIG. 1 is a schematic illustration of a prior art spark plug adapter.
Figure 2:
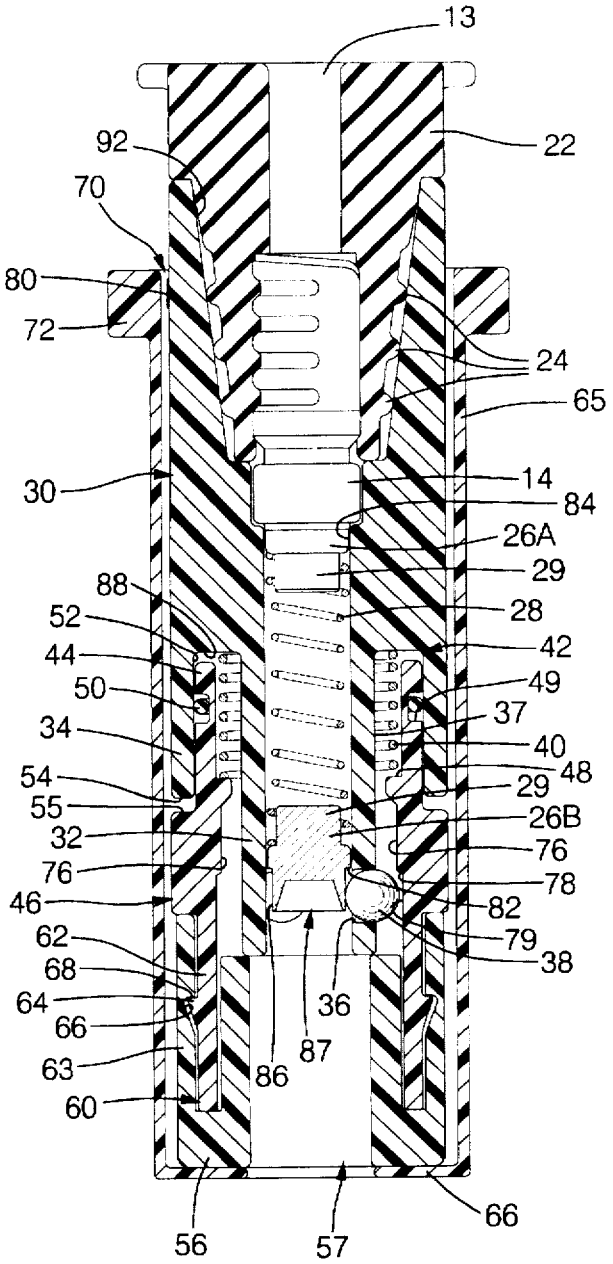
FIG. 2 is a sectional view of a spark plug adapter in an unmated position according to the present invention.

As illustrated in FIG. 2, starting with the maximum retention spark plug adapter in a retracted position, the sliding retainer 46 and the spark plug seal 56 are held against the compressed retainer coil spring 40 by the axial component Vy of the vectored force between the sliding retainer 46 and the sliding terminal 26b through the three retaining spheres 38. When the maximum retention spark plug adapter is at rest, the position described above and shown in FIG. 2 is maintained.

As mating to the spark plug occurs, the following sequence of events takes place. The spark plug terminal 17 contacts the sliding terminal 26b and begins compressing the terminal spring 28. Engagement occurs with the spark plug terminal replacing the sliding terminal 26b as the point of contact with the three retaining spheres 38. As further engagement continues, the spheres 38 are pushed inward radially by the horizontal component Vx of the force vector applied to the spheres by the sliding retainer shoulder 78 into a spark plug terminal undercut 20. As the retaining spheres move inwardly radially, a clearing develops for the shoulder 78 to slide pass the retaining spheres and for the spheres to be retained by the sliding retainer flat inside wall 76 in a locked position wherein the spheres engage the spark plug undercut surface 20. Once the clearance is achieved, the retaining spring moves the sliding retainer and attached spark plug seal into mated position as shown in FIG. 3.

As illustrated in FIG. 3, in the mated position, the retaining spheres 38 are trapped between the sliding retainer inside wall 76 and the spark plug terminal undercut 20. Maximum mechanical retention is achieved and maintained due to the change in internal diameter created by the inside wall 76 which prevents the retaining spheres 38 from moving radially outward, thereby trapping the spark plug terminal. Any increase in axial force on the maximum retention spark plug adapter at this point results in a higher normal force exerted on the spark plug terminal by the retaining spheres with no movement radially. Positive electrical conductivity is provided by the fully compressed terminal spring 28 pushing the sliding terminal against the spark plug terminal and the cable terminal respectively.

Removal is accomplished by applying an axial force to the sliding retainer 40, causing compression of the retainer spring. Once sufficient movement occurs the shoulder 78 and internal step clears the retaining spheres 38 allowing the spheres to move radially outward, thereby releasing the spark plug terminal. The spark plug terminal is replaced by the sliding terminal 26b as the spark plug is removed thereby returning the maximum retention spark plug adapter to the retracted position as shown in FIG. 2. The axial force can be applied directly to the sliding retainer 46 or to the optional removal cylinder 65. Another feature of the optional removable cylinder is a visual indicator 80, on the outer surface of the removable cylinder 65, which is hidden by the removal cylinder in the retracted position (FIG. 2) and exposed in the mated position (FIG. 3) thereby providing visual indication of full mated maximum retention spark plug adapter. The optional removal cylinder can be made by a variety of materials such as plastic or metal depending upon the environmental requirements.

Further detail regarding the maximum retention spark plug adapter is now provided. The spark plug seal 56 is a dielectric insulator of elastomeric material between the high voltage spark plug terminal and the hex on the spark plug. It also serves as an environmental and dielectric seal by providing a pressure seal in the interface area between the spark plug ceramic sleeve 21 and the spark plug seal 56.

The three retaining spheres 38 serve two functions. One is to mechanically retain the connector assembly to the spark plug after mating. The second is to keep the sliding retainer and spark plug seal assembly in the retracted position (FIG. 2) anytime the maximum retention spark plug adapter is not mated to the spark plug. The spheres are located symmetrically around the spark plug terminal.

The sliding retainer holds the retaining spheres 38 against the spark plug terminal undercut 20 insuring positive mechanical connection between the maximum retention spark plug adapter and the spark plug. It also supports the spark plug seal 56 and the sliding retainer O-ring. It also functions as a dielectric insulator as well as an environmental seal. The sliding retainer supports and positions the spark plug seal by shoulder 68 and also provides a locating groove 48 for the sliding retainer O-ring 50. The middle wall 76 of the sliding retainer positions the retaining spheres against the spark plug terminal post when the maximum retention spark plug adapter is in the mated position (FIG. 3). The shoulder 78 provides an internal step to a lower wall 79 positioned radially further away from the central axis of the adapter than the middle wall 78. In the retracted position (FIG. 2) this lower wall 79 positions the spheres against the sliding terminal.

The two sliding terminals **26*a*, 26*b* are designed to make electrical contact to the terminal post 17 on the spark plug as well as electrical contact to the cable terminal 14 on the spark plug cable. The sliding terminal 26*b* that contacts the spark plug terminal also serves to keep the sliding retainer in retracted position until mating to the spark plug occurs. The sliding terminal 26*b* has an outwardly extending ledge 82 which engages the sphere 38 and functions to limit the travel of the sliding terminal in the retracted position (FIG. 2) and to locate the sliding terminal in the connector body inner tube. The ledge 84 on the other sliding terminal 26*a*, which is the same as the ledge 82** on the first sliding terminal, functions as a locating feature for the sliding terminal and the cable terminal.

The terminal spring 28 is the electrical contact from one sliding terminal **26*a* to another sliding terminal 26*b*. The terminal spring is received on a projection 29 on each sliding terminal 26*a*, 26*b* with an interference fit. The terminal spring 28 serves to push the sliding terminal 26*b* into position as the adapter is disconnected to hold the maximum retention spark plug adapter in the retracted position. The sliding terminals 26*a*, 26*b* have a body 86 with a recess 87 formed therein to receive a male projection on the cable terminal 14 and the spark plug terminal 17** respectively.

The connector body 30 is the base to which all of the other components are attached. The connector body serves as a dielectric insulator as well as an environmental seal. As described earlier, the connector body includes three symmetrically located positioning holes in an internal tube or sleeve for securing the location of the retaining spheres. A shelf 88 is provided which connects the two spaced apart concentric inner and outer tubes or sleeves 32, 34 respectively. The shelf provides a positioning stop for the retaining spring 40.

The maximum retention spark plug adapter according to the present invention provides the following advantages. The adapter separates the mechanical connection from the electrical connection and maximizes the mechanical retention after mating. The adapter has repeatable and consistent engagement forces and repeatable and consistent electrical contact forces. The adapter is suitable for single and dual overhead cam and push-rod engine configurations with right angle, straight and intermediate angle configurations. The adapter is usable with a variety of spark plug terminal surface finishes and geometries. The adapter gives the visual feedback if maximum spark plug retention adapter is not fully mated. The adapter utilizes stored mechanical energy of the terminal spring to assist removal during service and to provide minimum disengagement force without damage when properly released. As such, the convenient removal feature of the adapter provides mechanical and electrical performances that do not deteriorate with repeated engagement/disengagement cycles. The adapter has symmetrical geometry to reduce electrical stress in relatively weak, high temperature areas. The adapter also allows for replacement of the wire cable seal assembly in the event of damage to the spark plug wire. Further, the adapter has increased cable retention and has precise location of the cable terminal to the seal, and locking features in the connector body and the cable seal precisely locating the terminal to the rest of the maximum retention spark plug adapter. The optional removal cylinder has an improved electrical ground when used as a metal heat shield and provides a uniformly distributed force around the spark plug seal to minimize potential damage to the seal during removal of the maximum retention spark plug adapter from the spark plug.

What is claimed is:

1. A spark plug adapter for making electrical and mechanical connection to a spark plug comprising:

a spark plug cable having a terminal at one end for making electrical connection to a spark plug terminal, a connector body having a central bore formed therein for receiving the cable terminal, said connector body having a first downwardly extending tubular sleeve for receiving said cable terminal and a portion of a spark plug terminal post, said first downwardly extending tubular sleeve having a hole formed near one end for receiving a spark plug terminal retaining ball;

a compression spring surrounding a portion of an outside wall of said first tubular sleeve, a sliding retainer constructed and arranged for slidable movement on the outer surface of the first tubular sleeve, said sliding retainer having an upwardly extending leg constructed and arranged to be spaced a distance from said first tubular member and defining a gap between the outer wall of the first tubular sleeve and the upwardly extending leg portion for receiving said compression spring, said sliding retainer including a ledge extending inwardly towards the first tubular sleeve to provide a stop and pressure point for the compression spring;

a main body portion of the sliding retainer extending downwardly from the ledge and having a first flat inside surface spaced a distance from the first tubular sleeve, and a second flat inside surface spaced from the first tubular sleeve a distance greater than the first flat surface and a shoulder extending between the first and second flat surfaces;

the sliding retainer being movable from a first retracted position wherein no spark plug is connected to the adapter and wherein the ball engages the second flat surface of the sliding retainer, and wherein the sliding retainer is movable from the first position to a second position wherein the sliding retainer is moved downwardly so that the shoulder engages the ball forcing the ball to move radially inward towards the spark plug terminal until the shoulder moves passed the ball and the ball is trapped between the first flat surface of the sliding retainer and the spark plug terminal and wherein said ball applies a force to the spark plug terminal to mechanically hold the spark plug in place.

2. A spark plug adapter as set forth in claim 1 wherein the ball engages an annular groove in a spark plug terminal when the adapter is in the second position.

3. A spark plug adapter as set forth in claim 1 further comprising a first sliding terminal for engaging the spark plug cable terminal and a second sliding terminal for engaging a terminal post of the spark plug, said first and second sliding terminals being connected together.

4. A spark plug adapter as set forth in claim 3 wherein said first and second sliding terminals are connected together by a terminal spring.

5. A spark plug adapter as set forth in claim 1 further comprising a removable cylinder having a tube-shaped body and a cap at one end having an opening for receiving a spark plug, and a spark plug seal received in the removable cylinder and retained by the cap.

6. A spark plug adapter as set forth in claim 1 wherein said first tubular sleeve has three holes formed therein each for receiving a ball.

7. A spark plug adapter as set forth in claim 1 wherein said sliding retainer has a groove formed in an outer wall of the upwardly extending leg and constructed and arranged for receiving a portion of an O-ring and wherein the O-ring engages a second downwardly extending tubular sleeve spaced apart from and concentric with the first downwardly extending tubular sleeve.

8. A spark plug adapter as set forth in claim 7 wherein said sliding retainer includes an outwardly extending ledge constructed and arranged to be selectively engaged by a lower end of the second downwardly extending tubular sleeve.

9. A spark plug adapter as set forth in claim 5 wherein said spark plug seal is constructed and arranged to receive a ceramic portion of a spark plug in a central bore formed in the seal, and wherein said spark plug seal has an annular recess formed therein constructed and arranged to receive the downwardly extending leg of the sliding retainer.

10. A spark plug adapter as set forth in claim 9 wherein said spark plug seal has a notch formed in an outer wall defining the annular recess and said downwardly extending leg of the sliding retainer includes an outwardly extending ledge received in the notch formed in the seal.

11. A spark plug adapter as set forth in claim 1 wherein the connector body has a marker on an outer surface thereof positioned to be hidden by the removable cylinder in a retracted position and exposed when the adapter is in a mated position thereby providing a visual indication of full mating of the spark plug adapter.

12. A spark plug adapter as set forth in claim 4 wherein said terminal spring biases one of the sliding terminals so as to engage the spherical ball pushing the ball radially outwardly when said adapter is in a retracted non-mating position.

13. A spark plug adapter for making electrical and mechanical connection to a spark plug comprising:

a spark plug cable having a terminal at one end for making electrical connection to a conductive core of the cable, a connector body having a central bore formed therein for receiving the cable terminal, said connector body having a downwardly extending tubular sleeve for receiving a portion of said cable terminal and a portion of a spark plug terminal post, said downwardly extending tubular body having a hole formed near one end for receiving a spark plug terminal retaining ball;

a compression spring surrounding a portion of an outer wall of the tubular sleeve, a sliding retainer constructed and arranged for slidable movement on the outer surface of a downwardly extending tubular sleeve, and constructed and arranged to be biased downwardly by said compression spring, said sliding retainer having a flat inside surface and an outwardly extending shoulder near one end;

the sliding retainer being removable from a first retracted position wherein no spark plug is connected to the adapter and wherein the flat surface and the shoulder are positioned above the ball, and wherein the sliding retainer is movable from the first position to an engaged position wherein the sliding retainer is moved downwardly so that the shoulder engages the ball forcing the ball to move radially inward towards the spark plug terminal until the shoulder moves passed the ball and the ball is trapped between the flat surface of the sliding retainer and the terminal post and wherein the ball applies a force to the spark plug terminal post to mechanically hold the spark plug in place.

* * * * *